US010941743B2

(12) United States Patent
Yamashita et al.

(10) Patent No.: US 10,941,743 B2
(45) Date of Patent: Mar. 9, 2021

(54) FUEL INJECTION VALVE

(71) Applicant: DENSO CORPORATION, Kariya (JP)

(72) Inventors: Tsukasa Yamashita, Kariya (JP); Kazufumi Serizawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 35 days.

(21) Appl. No.: 16/201,052

(22) Filed: Nov. 27, 2018

(65) Prior Publication Data

US 2019/0162148 A1 May 30, 2019

(30) Foreign Application Priority Data

Nov. 29, 2017 (JP) ..... 2017-229422

(51) Int. Cl.
*F02M 61/16* (2006.01)
*F02M 61/18* (2006.01)

(52) U.S. Cl.
CPC ..... *F02M 61/166* (2013.01); *F02M 61/1886* (2013.01); *F02M 2200/05* (2013.01); *F02M 2200/9038* (2013.01); *F02M 2200/9046* (2013.01)

(58) Field of Classification Search
CPC .... F02M 61/166; F02M 61/186; F02M 61/18; F02M 2200/02; F02M 2200/05; F02M 2200/9061; F02M 61/1886; F02M 2200/9038; F02M 2200/9046
USPC ..... 239/584
See application file for complete search history.

(56) References Cited

U.S. PATENT DOCUMENTS 5,478,651 A * 12/1995 Tannenbaum ..... C09D 127/12 427/388.4
5,924,674 A * 7/1999 Hahn ..... F02M 51/0614 251/129.01
6,489,043 B1 * 12/2002 Deevi ..... C22C 38/06 428/681
6,715,693 B1 * 4/2004 Dam ..... F02M 61/166 239/533.11
6,802,457 B1 * 10/2004 Campion ..... C23C 14/025 239/533.2

(Continued)

FOREIGN PATENT DOCUMENTS

DE 10 2005 038 385 2/2007
GB 2530991 4/2016

(Continued)

OTHER PUBLICATIONS

U.S. Appl. No. 16/201,052, filed Nov. 27, 2018, Fuel Injection Valve.

(Continued)

*Primary Examiner* — Joseph A Greenlund
(74) *Attorney, Agent, or Firm* — Nixon & Vanderhye P.C.

(57) ABSTRACT

A fuel injection valve includes a body that includes an injection hole through which fuel is injected, and a valve element that opens or closes the injection hole. The body includes a metallic base material configured to form the injection hole, a corrosion-resistant layer covering a surface of at least a part of the base material that forms the injection hole and being made of a less corrosive material than the base material, and a sacrificial corrosion layer located between the base material and the corrosion-resistant layer and made of a more corrosive material than the corrosion-resistant layer.

3 Claims, 5 Drawing Sheets

(56) References Cited

U.S. PATENT DOCUMENTS 10,626,834 B2 * 4/2020 Liu ..... C23C 28/322
2002/0050533 A1 * 5/2002 Hirota ..... F02M 51/0603 239/102.2
2003/0226912 A1 * 12/2003 Mohr ..... F02M 63/0026 239/533.2
2004/0026532 A1 2/2004 Lambert et al.
2005/0017098 A1 * 1/2005 Joseph ..... F02M 61/168 239/585.5
2006/0236974 A1 * 10/2006 Randall ..... F02M 61/18 123/299
2007/0012803 A1 * 1/2007 Shimizu ..... F02M 61/18 239/497
2007/0057095 A1 * 3/2007 Bayer ..... F16K 31/06 239/585.1
2007/0095952 A1 * 5/2007 Heinstein ..... F02M 61/168 239/585.1
2007/0264491 A1 * 11/2007 Asano ..... C23C 28/343 428/327
2008/0173733 A1 * 7/2008 Raab ..... F02M 61/1806 239/533.2
2008/0220257 A1 * 9/2008 Dekempeneer ..... C23C 28/322 428/408
2009/0140079 A1 * 6/2009 Bertini ..... C23C 28/044 239/584
2009/0159728 A1 * 6/2009 Suzuki ..... F02M 61/1813 239/584
2009/0302136 A1 * 12/2009 Song ..... F02M 21/0263 239/584
2010/0224706 A1 * 9/2010 Suzuki ..... F02M 61/166 239/584
2010/0276520 A1 * 11/2010 Lewis ..... F02M 61/18 239/589
2012/0118746 A1 * 5/2012 Isogai ..... C25D 9/02 205/50
2012/0204839 A1 * 8/2012 Ohwada ..... F02M 51/0671 123/472
2013/0112770 A1 * 5/2013 Hsieh ..... A61M 15/0085 239/102.1
2014/0097275 A1 * 4/2014 Wang ..... F02M 61/1806 239/584
2014/0209063 A1 * 7/2014 Feng ..... F02M 61/166 123/445
2015/0021417 A1 * 1/2015 Ukropec ..... C25D 11/026 239/584
2016/0230274 A1 * 8/2016 Flannery ..... C23C 28/343
2016/0230725 A1 * 8/2016 Katsumata ..... F16L 19/028
2017/0074222 A1 * 3/2017 Takaoku ..... F02M 51/0671
2017/0321645 A1 * 11/2017 Liu ..... C23C 28/341
2019/0162148 A1 * 5/2019 Yamashita ..... F02M 61/1886
2019/0162149 A1 * 5/2019 Yamashita ..... F02M 61/166
2020/0088148 A1 * 3/2020 Newman ..... F02M 61/168

FOREIGN PATENT DOCUMENTS

JP 55-117068 9/1980
JP 5-209575 8/1993
JP 3307722 5/2002
JP 6062543 1/2017
WO 91/15611 10/1991

OTHER PUBLICATIONS

U.S. Appl. No. 16/201,016, filed Nov. 27, 2018, Fuel Injection Valve.
U.S. Appl. No. 16/201,016 to Yamashita, et al., filed Nov. 27, 2018 (28 pages).

* cited by examiner

FUEL INJECTION VALVE

CROSS REFERENCE TO RELATED APPLICATION

This application is based on Japanese Patent Application No. 2017-229422 filed on Nov. 29, 2017, the disclosure of which is incorporated herein by reference.

TECHNICAL FIELD

The present disclosure relates to a fuel injection valve that injects fuel.

BACKGROUND

In regard to a fuel injection valve that injects fuel, which is used in combustion in an internal combustion engine, from an injection hole, condensed water may adhere to a valve body having the injection hole. The valve body may be concernedly corroded by the condensed water adhering thereto. In particular, when a portion having the injection hole in the valve body is corroded, a change in injection characteristics occurs, such as a change in a spray shape or an amount of the fuel injected from the injection hole.

A countermeasure against this issue is disclosed in JP H5-209575 A, in which the outer circumferential surface of the valve body and the inner circumferential surface of the injection hole are chromed to improve corrosion resistance of the valve body.

In a known a technique in the related art, part of exhaust gas from an internal combustion engine is refluxed as a reflux gas into intake air to reduce nitrogen oxide (NOx) as an object of the emission control. Recently, the amount of the reflux gas (EGR amount) tends to be increased with tighter control on exhaust emissions.

However, since the reflux gas contains a large amount of sulfur and nitrogen, increasing the EGR amount causes dissolution of a larger amount of sulfur and nitrogen in the condensed water adhering to the valve body, resulting in accelerated corrosion of the valve body. A measure against corrosion is therefore increasingly required for a recent valve body. The measure is however limitedly improved in the existent structure of the valve body only subjected to chromizing.

SUMMARY

The present disclosure addresses at least one of the above issues. Thus, it is an objective of the present disclosure to provide a fuel injection valve improved in the measure against corrosion.

To achieve the objective of the present disclosure, there is provided a fuel injection valve including a body that includes an injection hole through which fuel is injected, and a valve element that opens or closes the injection hole. The body includes a metallic base material configured to form the injection hole, a corrosion-resistant layer covering a surface of at least a part of the base material that forms the injection hole and being made of a less corrosive material than the base material, and a sacrificial corrosion layer located between the base material and the corrosion-resistant layer and made of a more corrosive material than the corrosion-resistant layer.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
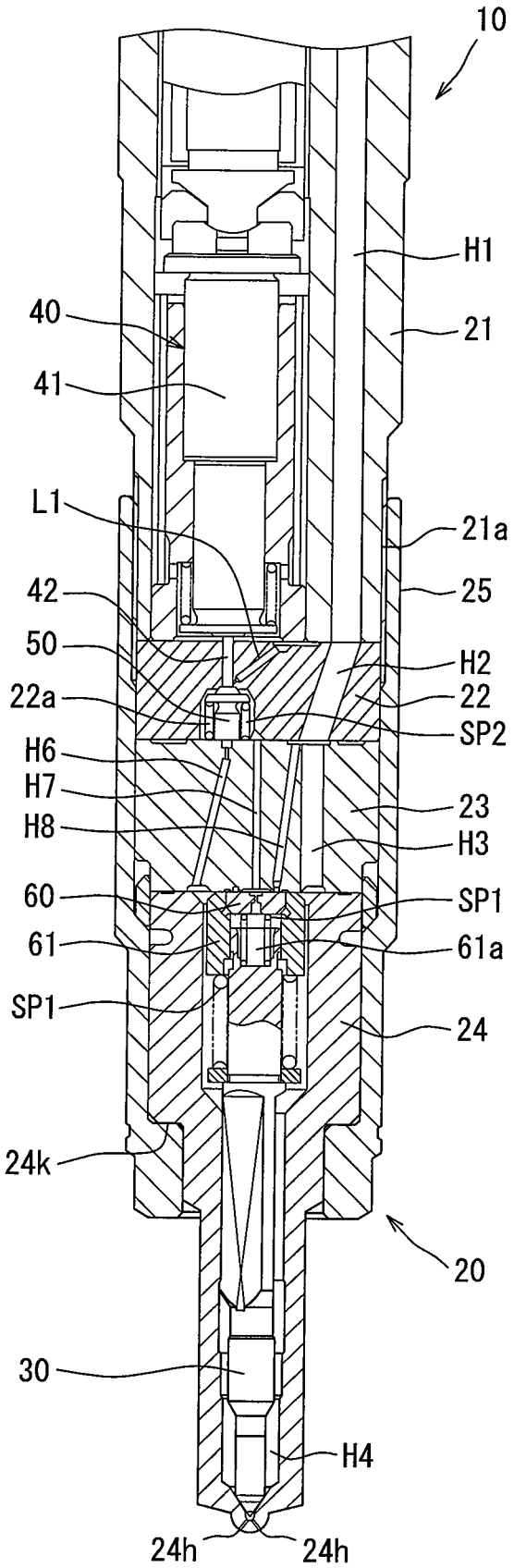
FIG. 1 is a sectional view of a fuel injection valve of a first embodiment.

Hereinafter, some embodiments will be described with reference to the accompanying drawings. In the embodiments, corresponding components are designated by the same reference numeral, and duplicated description may be omitted. When only a portion of a configuration is described in each embodiment, other portions of the configuration can be described using previous description of a configuration of another embodiment.

First Embodiment

A fuel injection valve of a first embodiment of the present disclosure injects fuel, which is used in combustion in an internal combustion engine, from an injection hole. The internal combustion engine is a compression ignition diesel engine, and is mounted in a vehicle as a traveling drive source. Fuel (for example, light oil) reserved in an undepicted fuel tank is pressure-fed into a common rail by a high-pressure fuel pump, and then distributed from the common rail into each fuel injection valve 10, and injected into a combustion chamber from the fuel injection valve 10.

As shown in FIG. 1, the fuel injection valve 10 includes a body 20, a valve needle 30, a drive part 40, a control valve element 50, a control plate 60, and a cylinder 61.

The body 20 includes a plurality of metal components such as a drive part body 21, a valve plate 22, an orifice plate 23, and a valve body 24, which are combined together by a retaining nut 25. Specifically, the retaining nut 25 is fastened to a screw part 21*a* of the drive part body 21 while being stopped by a stopping part 24*k* of the valve body 24. Consequently, the valve body 24 and the drive part body 21 are fastened so as to approach each other in an axial direction. As a result, the valve plate 22 and the orifice plate 23 located between the valve body 24 and the drive part body 21 are held by the valve body 24 and the drive part body 21.

The valve needle 30, the control plate 60, and the cylinder 61 are accommodated in the valve body 24, the drive part 40 is accommodated in the drive part body 21, and the control valve element 50 is accommodated in the valve plate 22. Furthermore, high-pressure passages H1, H2, H3, H4, and H5 are formed in the drive part body 21, the valve plate 22, the orifice plate 23, and the valve body 24 so that a high-pressure fuel, which is supplied from a common rail in a distributed manner, flows therethrough.

The high-pressure passage H4 within the valve body 24 is a circular passage formed between an outer circumferential surface of the valve needle 30 and an inner wall surface 24in (see FIG. 2) of the valve body 24. The high-pressure passage H5 (see FIG. 3) within the valve body 24 is formed between an end surface of the valve needle 30 and the inner wall surface 24in of the valve body 24. The high-pressure passage H5 is in communication with the downstream side of the high-pressure passage H4, and may be referred to as suck chamber to gather the high-pressure fuel that is annually distributed in the high-pressure passage H4. The valve body 24 has a plurality of injection holes 24*h* that inject fuel. The high-pressure passage H5 (suck chamber) is in communication with the upstream side of each injection hole 24*h*, and distributes the high-pressure fuel to the injection hole 24*h*. The valve body 24 corresponds to "body" having the injection holes 24*h*, and the valve needle 30 corresponds to "valve element" that opens and closes the injection holes 24*h*.

The inner wall surface 24in of the valve body 24 has a portion that forms the high-pressure passage H4 and is located directly above the high-pressure passage H5, and the portion serves as a seat surface 24*s* which the valve needle 30 is seated on or separated from. In a state where the valve needle 30 is lifted up (valve opening operation) and thus separated from the seat surface 24*s*, the high-pressure passage H4 is opened so that the high-pressure fuel is injected from the injection holes 24*h*. In a state where the valve needle 30 is lifted down (valve closing operation) and thus seated on the seat surface 24*s*, the high-pressure passage H4 is closed so that fuel injection from the injection holes 24*h* is stopped.

The cylinder 61 is accommodated in the valve body 24 while being held between a resilient member SP1 and the orifice plate 23, and the control plate 60 is disposed slidably in the cylinder 61. A control chamber 61*a* to be filled with the fuel is provided on the counter injection hole-side of the valve needle 30. The control chamber 61*a* is surrounded by the inner circumferential surface of the cylinder 61, the surface on the injection hole-side of the control plate 60, and the surface on the counter injection hole-side of the valve needle 30.

The valve plate 22 has an accommodation chamber 22*a* that accommodates the control valve element 50 and a low-pressure passage L1 in communication with the accommodation chamber 22*a*. The orifice plate 23 has a high-pressure passage H6 that allows the high-pressure passage H4 to communicate with the accommodation chamber 22*a*, a high-pressure passage H7 that allows the accommodation chamber 22*a* to communicate with the control chamber 61*a*, and a high-pressure passage H8 that allows the high-pressure passage H2 to communicate with the control chamber 61*a*. The control valve element 50 opens and closes communication between the accommodation chamber 22*a* and the low-pressure passage L1, and between the high-pressure passage H6 and the accommodation chamber 22*a*. The control plate 60 opens and closes communication between the high-pressure passage H8 and the control chamber 61*a*.

The drive part 40 is an electromotive actuator, and includes a piezo stack 41 and a rod 42. The piezo stack 41, which is a stack of a plurality of piezo elements, extends upon energization start, and contracts upon energization stop. The rod 42 transmits extension force of the piezo stack 41 to the control valve element 50 and pushes down the control valve element 50.

Operation of the fuel injection valve 10 is now described.

When energization of the piezo stack 41 is started, the control valve element 50 is pushed down by the drive part 40. As a result, the accommodation chamber 22*a* communicates with the low-pressure passage L1, and communication between the high-pressure passage H6 and the accommodation chamber 22*a* is blocked. Consequently, the fuel in the control chamber 61*a* flows out through the high-pressure passage H7, the accommodation chamber 22*a*, and the low-pressure passage L1 in this order, so that fuel pressure (back pressure) in the control chamber 61*a* decreases. As a result, the valve needle 30 performs valve opening operation against valve closing force exerted from the resilient member SP1, and the fuel is injected from the injection holes 24*h*.

When energization of the piezo stack 41 is stopped, the control valve element 50 is pushed up by a resilient component SP2. As a result, communication between the accommodation chamber 22*a* and the low-pressure passage L1 is blocked, and the high-pressure passage H6 communicates with the accommodation chamber 22*a*. Consequently, the high-pressure fuel flows into the control chamber 61*a* from the high-pressure passage H6 through the accommodation chamber 22*a* and the high-pressure passage H7, so that fuel pressure (back pressure) in the control chamber 61*a* increases. As a result, the valve needle 30 performs valve closing operation, and the fuel is injected from the injection holes 24*h*. The control plate 60 performs opening operation immediately after start of fuel flow into the control chamber 61*a* from the high-pressure passage H7, and thus the high-pressure passage H8 communicates with the control chamber 61*a*. Consequently, the high-pressure fuel flows into the control chamber 61*a* from both the high-pressure passages H7 and H8, which prompts an increase in back pressure after energization start, leading to improvement in valve closing response of the valve needle 30.

A portion having the injection holes 24*h* in the valve body 24 is exposed to the combustion chamber of the internal combustion engine, and subjected to air-fuel mixture before combustion and exhaust gas after combustion. When temperature of the exhaust gas remaining in the combustion chamber lowers after stop of the internal combustion engine, a water component contained in the exhaust gas may be condensed and adhere to the valve body 24. Since the exhaust gas contains nitrogen and sulfur, the condensed water adhering to the valve body 24 also contains nitrogen and sulfur. The valve body 24 requires corrosion resistance against water containing nitrogen and sulfur dissolved therein, i.e., requires to have a property such that the valve body is less likely to undergo an oxidation reaction with acid water. In particularly, the EGR amount recently tends to be increased as described above, and thus high corrosion resistance is required.

A structure of the valve body 24, which allows the above-described corrosion resistance to be exhibited, is now described with reference to FIG. 4.

Figure 2:
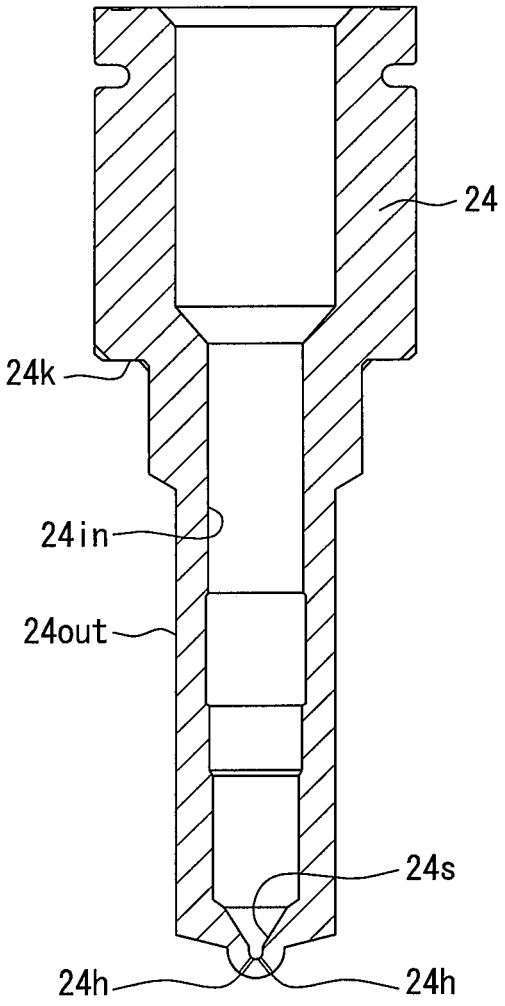
FIG. 2 is a sectional view of a valve body in FIG. 1.
Figure 3:
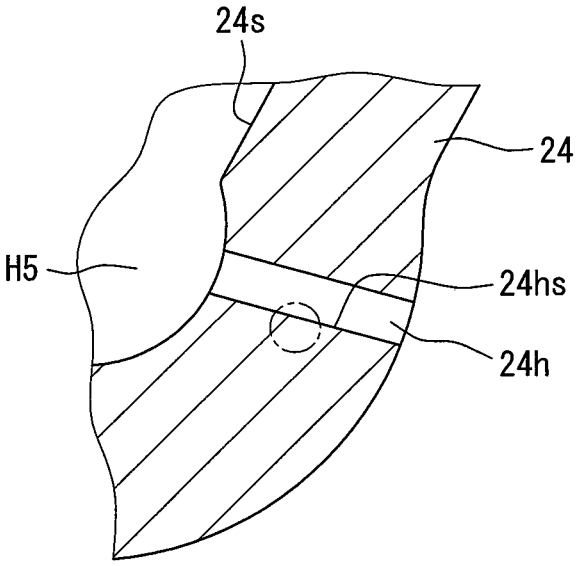
FIG. 3 is an enlarged view of FIG. 2.
Figure 4:
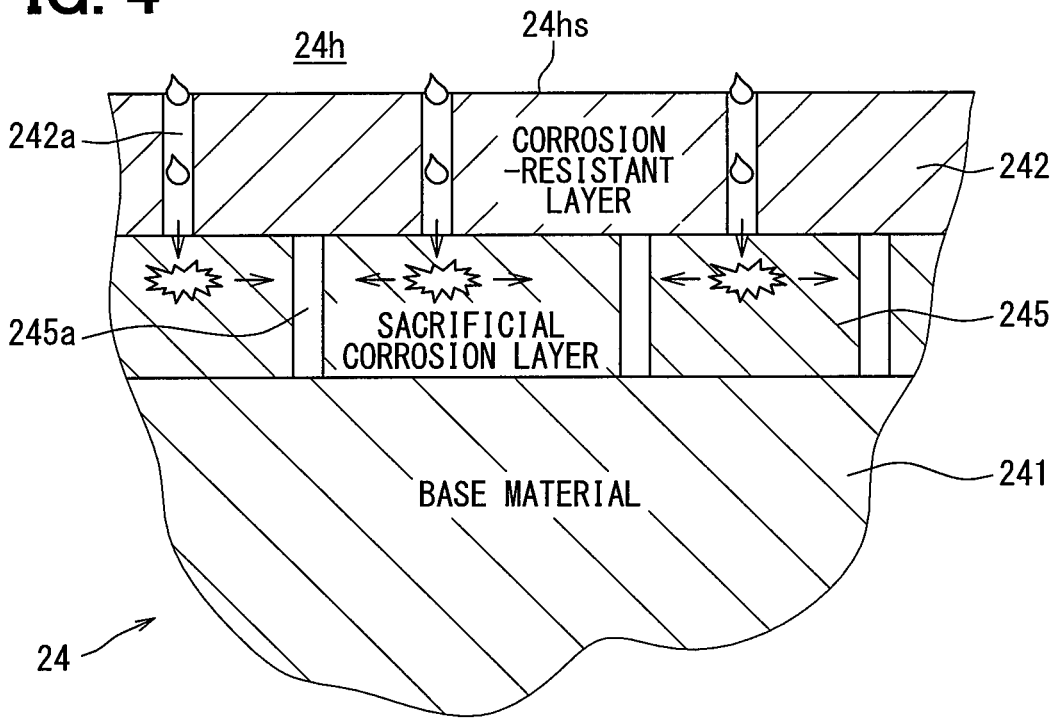
FIG. 4 is an enlarged view of a portion shown by a dot-and-dash line in FIG. 3.

As shown in FIG. 4, the valve body 24 includes a base material 241, a corrosion-resistant layer 242, and a sacrificial corrosion layer 245. The base material 241 includes an iron-based metal mainly containing iron, and is formed into a shape as shown in FIG. 2 by working a cylindrical parent metal. The sacrificial corrosion layer 245 and the corrosion-resistant layer 242 are stacked on the entire surface of the base material 241, i.e., on the entire inner wall surface 24in and the entire outer wall surface 24out (see FIG. 2).

The corrosion-resistant layer 242 is made of a material that is less corrosive than the base material, for example, tantalum oxide ($Ta_2O_5$), niobium oxide ($Nb_2O_5$), and titanium oxide ($TiO_2$). The material of the corrosion-resistant layer 242 is desirably an amorphous material having an aperiodic atomic arrangement, but may be a crystalline material having a periodic atomic arrangement.

The sacrificial corrosion layer 245 is located between the base material 241 and the corrosion-resistant layer 242, and is made of a material such as a metal oxide that is more corrosive than the corrosion-resistant layer 242. For example, a material of the sacrificial corrosion layer 245 contains the same components as the several types of metal oxides contained in the corrosion-resistant layer 242, but has a mixing ratio of such components that is different from the mixing ratio of the corrosion-resistant layer 242 so as to be more corrosive than the corrosion-resistant layer 242. Alternatively, the material of the sacrificial corrosion layer 245 mainly contains the same component as the main component (for example, iron) of the base material 241.

In any case, the material of the sacrificial corrosion layer 245 desirably liquates at a hydrogen-ion exponent (PH) of 4 or less. That is, when a condensed water that arrives at the sacrificial corrosion layer 245 has a PH of 4 or less, the sacrificial corrosion layer 245 is oxidized and liquates by the condensed water. More desirably, the material of the sacrificial corrosion layer 245 liquates at a hydrogen-ion exponent (PH) of 2 or less.

The corrosion-resistant layer 242 has a thickness equal to that of the sacrificial corrosion layer 245. Such a thickness is desirably less than 0.5 μm. The corrosion-resistant layer 242 has a linear expansion coefficient different from that of the base material 241. The linear expansion coefficient of the sacrificial corrosion layer 245 has a value intermediate between those of the corrosion-resistant layer 242 and the base material 241. The corrosion-resistant layer 242 has a Young's modulus different from that of the base material 241. The Young's modulus of the sacrificial corrosion layer 245 has a value intermediate between those of the corrosion-resistant layer 242 and the base material 241.

The corrosion-resistant layer 242 and the sacrificial corrosion layer 245 are each formed by a method of depositing a film on a surface of the base material 241 through a chemical reaction in a vapor phase, i.e., formed by a chemical vapor deposition process. In particular, the corrosion-resistant layer 242 and the sacrificial corrosion layer 245 are each desirably formed by atomic layer deposition (ALD) as one chemical vapor deposition process. Specifically, first, a heated base material 241 is placed in a chamber. Subsequently, a gaseous material as a precursor of the sacrificial corrosion layer 245 is loaded in the chamber to form the sacrificial corrosion layer 245 on the surface of the base material 241. Subsequently, a gaseous material as a precursor of the corrosion-resistant layer 242 is loaded in the chamber to form the corrosion-resistant layer 242 on the surface of the sacrificial corrosion layer 245.

Since the sacrificial corrosion layer 245 and the corrosion-resistant layer 242 are thus stacked on the surface of the base material 241 by a chemical vapor deposition process, the sacrificial corrosion layer 245 comes into contact with the surface of the base material 241, and the corrosion-resistant layer 242 comes into contact with the surface of the sacrificial corrosion layer 245. The surface of the corrosion-resistant layer 242 is exposed to each of injection holes 24*h*, and serves as an inner wall surface 24*hs* of the injection hole 24*h*.

In this way, in the first embodiment, the valve body 24 includes the base material 241, the corrosion-resistant layer 242, and the sacrificial corrosion layer 245. The base material 241 is made of a metal in which the injection holes 24*h* are formed. The corrosion-resistant layer 242 covers a surface of at least a portion of the base material 241, in which the injection holes 24*h* are formed, and is made of a material less corrosive than the base material 241. The material of the sacrificial corrosion layer 245 is more corrosive than the corrosion-resistant layer 242.

As shown in FIG. 4, strictly, a defect exists in the corrosion-resistant layer 242 and forms a through-hole 242*a* penetrating the corrosion-resistant layer 242 in a stacking direction. For example, the gaseous material as the precursor of the corrosion-resistant layer 242 does not adhere to a part of the surface of the sacrificial corrosion layer 245 during ALD, and such a part forms the defect. The sacrificial corrosion layer 245 also has a through-hole 245*a* formed by the defect as with the corrosion-resistant layer 242. In particular, when one film is formed in one step by a chemical vapor deposition process, a defect in the film tends to have a shape so as to penetrate the film (through-hole). However, since the corrosion-resistant layer 242 and the sacrificial corrosion layer 245 are formed in different steps, the through-hole 242*a* of the corrosion-resistant layer 242 comes into communication with the through-hole 245*a* of the sacrificial corrosion layer 245 at a low possibility.

Figure 5:
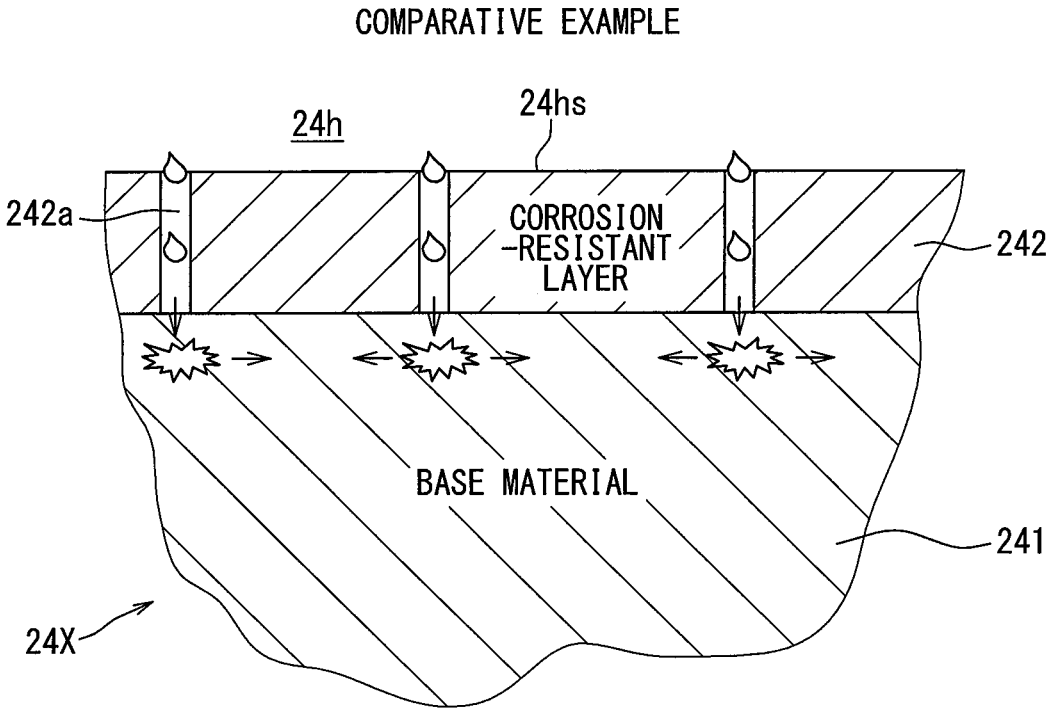
FIG. 5 is a sectional view of a valve body as a comparative example with the first embodiment.

For example, when the sacrificial corrosion layer 245 is not provided contrary to the first embodiment like a valve body 24X as a comparative example as shown in FIG. 5, the base material 241 may be concernedly corroded as described below. Specifically, condensed water adhering to the inner wall surface 24*hs* penetrates the corrosion-resistant layer 242 in a thickness direction through the through-hole 242*a* of the corrosion-resistant layer 242 and reaches the base material 241, and thus the base material 241 is oxidized (corroded) and becomes insufficient in strength.

On the other hand, since the sacrificial corrosion layer 245 is provided in the first embodiment, even when condensed water adhering to the inner wall surface 24*hs* passes through the through-hole 242*a* of the corrosion-resistant layer 242, such condensed water is subjected to an oxidation reaction in the sacrificial corrosion layer 245 and undergoes a chemical change. It is therefore possible to suppress arrival of the condensed water at the base material 241 through the through-hole 245*a* of the sacrificial corrosion layer 245. Consequently, it is possible to suppress oxidation of the base material 241 by the condensed water, and thus suppress corrosion of the base material 241. In short, the sacrificial corrosion layer 245 is corroded prior to the base material 241 and thus decreases the amount of the condensed water that penetrates the corrosion-resistant layer 242 and arrives at the base material 241. This makes it possible to suppress corrosion of the base material 241.

When the base material 241 is corroded by the condensed water, a surface of the base material 241 on a side close to the corrosion-resistant layer 242 is greatly hollowed by the corrosion. The sacrificial corrosion layer 245 and the corrosion-resistant layer 242 stacked in such a hollowed portion rise and easily fall off from the base material 241. When the layers thus fall off from the base material 241, the shape of the inner wall surface 24*hs* of the injection hole 24*h* is changed, leading to a change in injection characteristics, such as a change in a spray shape or injection amount of the fuel injected from the injection hole 24*h*. With regard to such a problem, in the first embodiment, it is possible to suppress corrosion of the base material 241 by providing the sacrificial corrosion layer 245 as described above, and thus suppress the change in injection characteristics due to falling off of each layer. Thickness of the sacrificial corrosion layer 245 is extremely small compared with a thickness dimension of the base material 241. The corroded sacrificial corrosion layer 245 is therefore not greatly hollowed unlike the corroded base material 241; hence, the corrosion-resistant layer 242 stacked in the hollowed portion falls off at a low possibility.

Furthermore, in the first embodiment, the material of the sacrificial corrosion layer 245 liquates at a hydrogen-ion exponent of 4 or less. Hence, the condensed water is easily subjected to an oxidation reaction in the sacrificial corrosion layer 245, which makes it possible to reduce a possibility that the condensed water arrives at the base material 241 while being not subjected to the oxidation reaction in the sacrificial corrosion layer 245.

Second Embodiment

Figure 6:
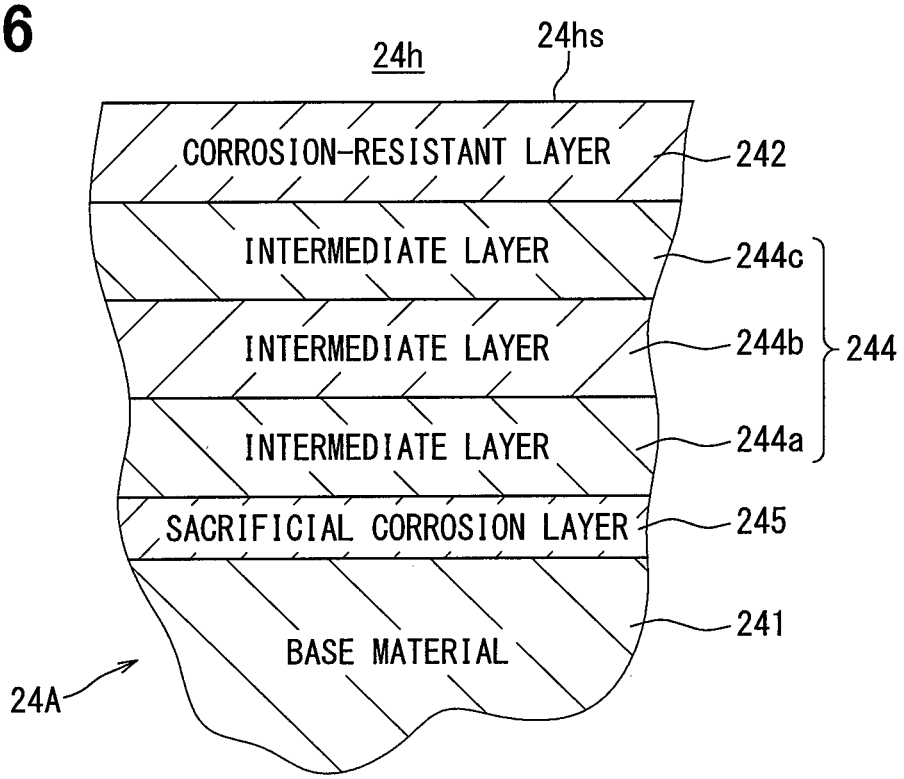
FIG. 6 is a sectional view of a valve body of a second embodiment.

As shown in FIG. 6, a valve body 24A of a second embodiment has an intermediate layer 244 located between the sacrificial corrosion layer 245 and the corrosion-resistant layer 242. The intermediate layer 244 is provided by stacking a plurality of films. In FIG. 6, the respective films are denoted as intermediate layers 244*a*, 244*b*, and 244*c*.

The intermediate layers 244*a*, 244*b*, and 244*c* are each formed by a method of depositing a film on a surface of the sacrificial corrosion layer 245 through a chemical reaction in a vapor phase, i.e., formed by a chemical vapor deposition process. In particular, the intermediate layers 244*a*, 244*b*, and 244*c* are desirably formed by atomic layer deposition (ALD) as one chemical vapor deposition process.

The linear expansion coefficient of the intermediate layer 244 is lower than that of one of the sacrificial corrosion layer 245 and the corrosion-resistant layer 242, and higher than that of the other of them. For example, when the linear expansion coefficient of the corrosion-resistant layer 242 is higher than that of the sacrificial corrosion layer 245, the linear expansion coefficient of the intermediate layer 244 is set to a value lower than that of the corrosion-resistant layer 242 (one) and higher than that of the sacrificial corrosion layer 245 (the other). Furthermore, the linear expansion coefficient of any of the intermediate layers 244*a*, 244*b*, and 244*c* is set to gradually increase as the intermediate layer approaches the one of the sacrificial corrosion layer 245 and the corrosion-resistant layer 242, and gradually decrease as the intermediate layer approaches the other of them.

The Young's modulus of the intermediate layer 244 is lower than that of one of the sacrificial corrosion layer 245 and the corrosion-resistant layer 242, and higher than that of the other of them. For example, when the Young's modulus of the corrosion-resistant layer 242 is higher than that of the sacrificial corrosion layer 245, the Young's modulus of the intermediate layer 244 is set to a value lower than that of the corrosion-resistant layer 242 (one), and higher than that of the sacrificial corrosion layer 245 (the other). Furthermore, the Young's modulus of any of the intermediate layers 244*a*, 244*b*, and 244*c* is set to gradually increase as the intermediate layer approaches the one of the sacrificial corrosion layer 245 and the corrosion-resistant layer 242, and gradually decrease as the intermediate layer approaches the other of them.

Metal components forming the intermediate layer 244 include both a metal component forming the sacrificial corrosion layer 245 and a metal component forming the corrosion-resistant layer 242. Specifically, first, as in the first embodiment, a gaseous material (first precursor) as a precursor of the sacrificial corrosion layer 245 is loaded in a chamber, in which the base material 241 is placed, to form the sacrificial corrosion layer 245 on the surface of the base material 241. Subsequently, both a gaseous material (second precursor) as a precursor of the corrosion-resistant layer 242 and the first precursor are loaded in the chamber to form the first intermediate layer 244*a* on the surface of the sacrificial corrosion layer 245.

Subsequently, both the first precursor and the second precursor are loaded in the chamber to form the second intermediate layer 244*b* on the surface of the first intermediate layer 244*a*. Subsequently, the first precursor and the second precursor are loaded in the chamber to form the third intermediate layer 244*c* on the surface of the second intermediate layer 244*b*. The loading ratio of the first precursor to the second precursor is varied between the formation steps of the intermediate layers 244*a*, 244*b*, and 244*c* to set the linear expansion coefficient and the Young's modulus as described above. The intermediate layers 244*a*, 244*b*, and 244*c* have the same thickness. Subsequently, the second precursor is loaded in the chamber to form the corrosion-resistant layer 242 on the surface of the intermediate layer 244*c*.

Since the material of the intermediate layer 244 is a mixture of the precursors of the sacrificial corrosion layer 245 and the corrosion-resistant layer 242 as described above, the corrosion resistance of the intermediate layer 244 is lower than that of the corrosion-resistant layer 242 and higher than that of the sacrificial corrosion layer 245. Corrosion resistance of any of the intermediate layers 244*a*, 244*b*, and 244*c* is gradually reduced as the intermediate layer approaches the sacrificial corrosion layer 245.

When the intermediate layer 244 is not provided contrary to the second embodiment, thermal expansion or thermal contraction of the valve body 24A may concernedly cause damage such as separation or cracks at a boundary of the sacrificial corrosion layer 245 and the corrosion-resistant layer 242 due to a difference in the linear expansion coefficient between the sacrificial corrosion layer 245 and the corrosion-resistant layer 242. On the other hand, the valve body 24A of the second embodiment has the intermediate layer 244 located between the sacrificial corrosion layer 245 and the corrosion-resistant layer 242. The linear expansion coefficient of the intermediate layer 244 is lower than that of one of the sacrificial corrosion layer 245 and the corrosion-resistant layer 242, and higher than that of the other of them. It is therefore possible to reduce a difference in the linear expansion coefficient between adjacent layers, which suppresses the concern of the damage.

Furthermore, the linear expansion coefficient of any of the intermediate layers 244*a*, 244*b*, and 244*c* gradually increases as the intermediate layer approaches the one of the sacrificial corrosion layer 245 and the corrosion-resistant layer 242, and gradually decreases as the intermediate layer approaches the other of them. This makes it possible to reduce the difference in the linear expansion coefficient between the intermediate layer 244*a* and the sacrificial corrosion layer 245, and also reduce the difference in the linear expansion coefficient between the intermediate layer 244*c* and the corrosion-resistant layer 242 compared with a case where the intermediate layer 244 as a whole has one linear expansion coefficient. Consequently, the concern of the damage can be promptly suppressed.

When the intermediate layer 244 is not provided contrary to the second embodiment, deformation of the valve body 24A by external force may concernedly cause damage such as separation or cracks at a boundary of the sacrificial corrosion layer 245 and the corrosion-resistant layer 242 due to a difference in Young's modulus between the sacrificial corrosion layer 245 and the corrosion-resistant layer 242. On the other hand, in the second embodiment, the Young's modulus of the intermediate layer 244 is lower than that of one of the sacrificial corrosion layer 245 and the corrosion-resistant layer 242 and higher than that of the other of them. It is therefore possible to reduce a difference in the Young's modulus between adjacent layers, which suppresses the above-described concern of the damage.

Furthermore, the Young's modulus of any of the intermediate layers 244*a*, 244*b*, and 244*c* gradually increases as the intermediate layer approaches the one of the sacrificial corrosion layer 245 and the corrosion-resistant layer 242, and gradually decreases as the intermediate layer approaches the other of them. This makes it possible to reduce the difference in the Young's modulus between the intermediate layer 244*a* and the sacrificial corrosion layer 245, and also reduce the difference in the Young's modulus between the intermediate layer 244*c* and the corrosion-resistant layer 242 compared with a case where the intermediate layer 244 as a whole has one Young's modulus. Consequently, the concern of the damage can be promptly suppressed.

Furthermore, in the second embodiment, the metal components forming the intermediate layer 244 include both the metal component forming the sacrificial corrosion layer 245 and the metal component forming the corrosion-resistant layer 242. It is therefore possible to easily make the linear expansion coefficient or the Young's modulus of the intermediate layer to be lower than that of the one of the sacrificial corrosion layer 245 and the corrosion-resistant layer 242, and higher than that of the other of them.

Third Embodiment

Figure 7:
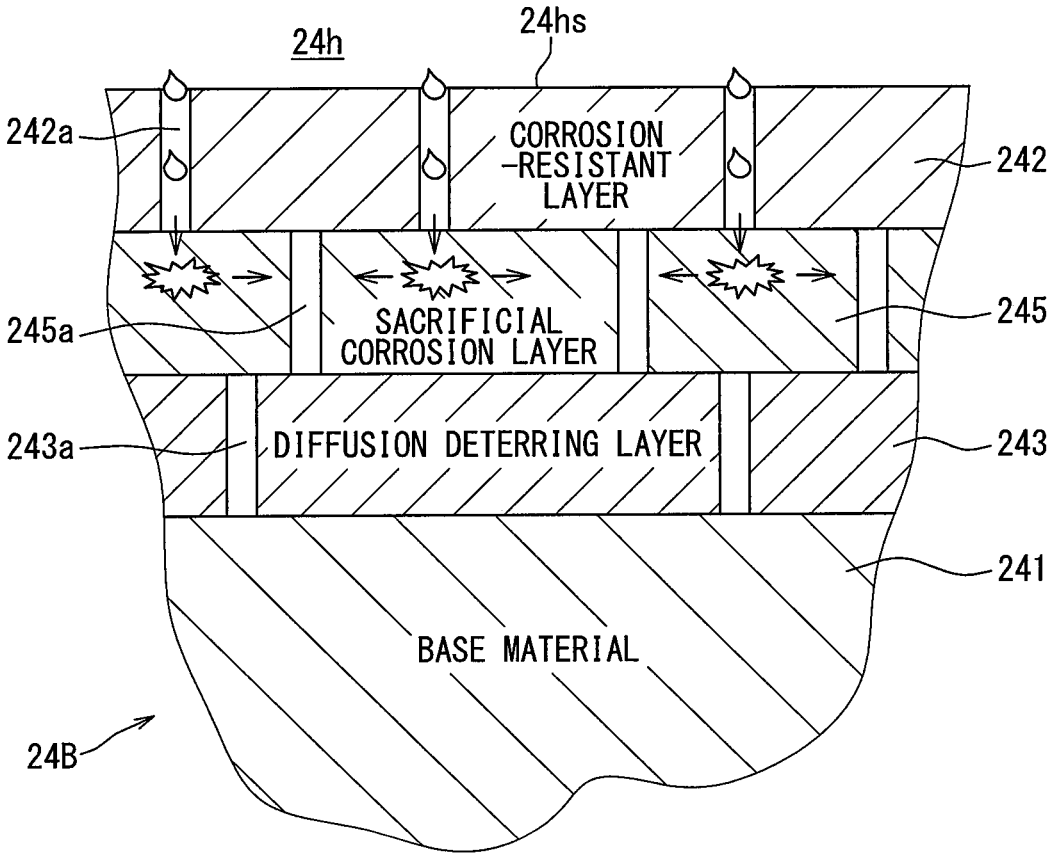
FIG. 7 is a sectional view of a valve body of a third embodiment.

The valve body 24 of the first embodiment has a structure where the sacrificial corrosion layer 245 and the corrosion-resistant layer 242 are provided on the base material 241 as shown in FIG. 4. On the other hand, a valve body 24B of a third embodiment has a structure where a diffusion deterring layer 243 is provided on the base material 241 in addition to the sacrificial corrosion layer 245 and the corrosion-resistant layer 242 as shown in FIG. 7. The diffusion deterring layer 243 is now described in detail.

The diffusion deterring layer 243 is located between the base material 241 and the sacrificial corrosion layer 245, and is made of a material, for example, aluminum oxide ($Al_2O_3$), in which diffusion of a metal component (for example, iron) of the base material 241 is less likely to occur than in the corrosion-resistant layer 242 and in the sacrificial corrosion layer 245. Although "diffusion" is known as a phenomenon where a substance spreads in a gas or liquid, atoms, ions, or defects may also migrate and diffuse in a solid. The diffusion deterring layer 243 is made of a material that is less likely to allow entrance and diffusion of the metal atoms of the base material 241. The material of the diffusion deterring layer 243 is desirably an amorphous material having an aperiodic atomic arrangement, but may be a crystalline material having a periodic atomic arrangement.

The diffusion deterring layer 243 is formed between the sacrificial corrosion layer 245 and the base material 241. For example, the diffusion deterring layer 243 is formed on the base material 241 by a chemical vapor deposition process (for example, ALD) together with the corrosion-resistant layer 242 and the sacrificial corrosion layer 245. Specifically, first, a heated base material 241 is placed in a chamber. Subsequently, a gaseous material as a precursor of the diffusion deterring layer 243 is loaded in the chamber to form the diffusion deterring layer 243 on the surface of the base material 241. Subsequently, a gaseous material as a precursor of the sacrificial corrosion layer 245 is loaded in the chamber to form the sacrificial corrosion layer 245 on the surface of the diffusion deterring layer 243. Subsequently, a gaseous material as a precursor of the corrosion-resistant layer 242 is loaded in the chamber to form the corrosion-resistant layer 242 on the surface of the sacrificial corrosion layer 245. The sacrificial corrosion layer 245 has a thickness equal to the thickness of the corrosion-resistant layer 242 or the diffusion deterring layer 243.

In this way, the valve body 24B of the third embodiment includes the diffusion deterring layer 243 in addition to the sacrificial corrosion layer 245 and the corrosion-resistant layer 242. The diffusion deterring layer 243 is located between the base material 241 and the sacrificial corrosion layer 245, and is made of a material in which diffusion of the metal component of the base material 241 is less likely to occur than in the sacrificial corrosion layer 245. This eliminates direct diffusion of the metal component of the base material 241 to the sacrificial corrosion layer 245. Thus, the diffusion deterring layer 243 deters diffusion of the metal component to the sacrificial corrosion layer 245 and the corrosion-resistant layer 242.

Specifically, in the third embodiment, since the diffusion deterring layer 243 is in contact with the base material 241, diffusion of the metal component from the base material 241 is immediately deterred by the diffusion deterring layer 243. It is therefore possible to enhance the effect of deterring diffusion of the metal component of the base material 241 to the corrosion-resistant layer 242.

Fourth Embodiment

Figure 8:
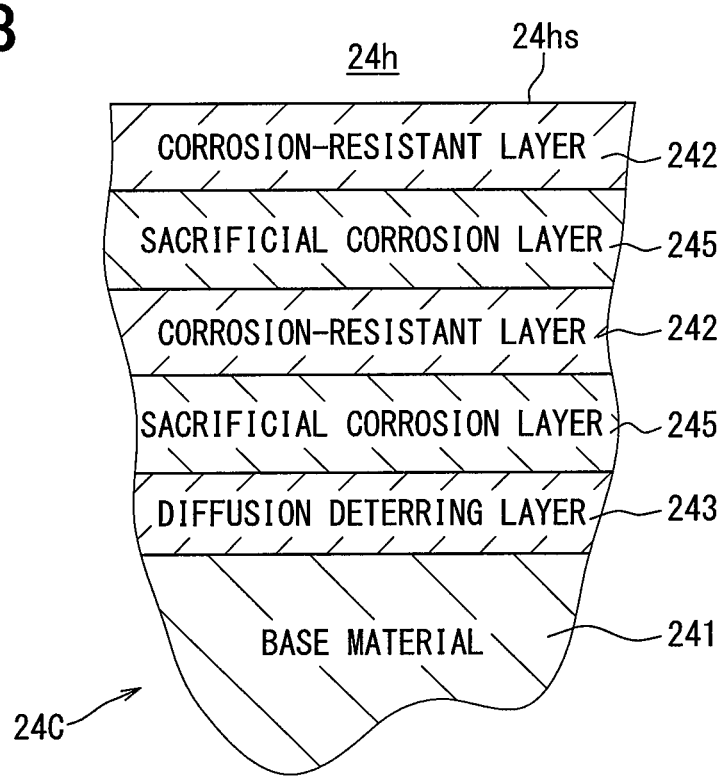
FIG. 8 is a sectional view of a valve body of a fourth embodiment.

The valve body 24B of the third embodiment includes one corrosion-resistant layer 242 and one sacrificial corrosion layer 245. On the other hand, a valve body 24C of a fourth embodiment as shown in FIG. 8 includes a plurality of sacrificial corrosion layers 245 and a plurality of corrosion-resistant layers 242, which are alternately disposed in a stacking manner.

The respective layers of the corrosion-resistant layers 242 and the sacrificial corrosion layers 245 are different in linear expansion coefficient and in Young's modulus from one another. The example of FIG. 8 includes two corrosion-resistant layers 242 and two sacrificial corrosion layers 245, i.e., the total number of such layers is four. The linear expansion coefficient and the Young's modulus of any of such layers each gradually vary as the layer approaches the base substrate 241. For example, each of the linear expansion coefficient and the Young's modulus is set to a larger value for one of the four layers closer to the base material 241. Alternatively, each of the linear expansion coefficient and the Young's modulus is set to a smaller value for one of the four layers closer to the base material 241.

In this way, in the fourth embodiment, the valve body 24C includes the plurality of sacrificial corrosion layers 245 and the plurality of corrosion-resistant layers 242, which are alternately disposed in a stacking manner. It is therefore possible to further reduce a possibility of arrival of the condensed water at the diffusion deterring layer 243 and the base material 241. Since the through-holes 242*a* and 245*a* formed in the respective layers come into direct communication with each other at a low possibility, the possibility of arrival of the condensed water can be reduced compared with the case where one corrosion-resistant layer 242 and one sacrificial corrosion layer 245 are provided with an increased thickness.

When the respective layers of the corrosion-resistant layers 242 and the sacrificial corrosion layers 245 are not different in linear expansion coefficient contrary to the fourth embodiment, the following concern occurs. Specifically, thermal expansion or thermal contraction of the valve body 24B may concernedly cause damage such as separation or cracks at a boundary between the layers due to a difference in the linear expansion coefficient between the layers. With regard to such a concern, in the fourth embodiment, the respective layers of the corrosion-resistant layers 242 and the sacrificial corrosion layers 245 are different in linear expansion coefficient. The linear expansion coefficient of any of the layers gradually varies as the layer approaches the base material 241. It is therefore possible to reduce a difference in the linear expansion coefficient between adjacent layers, which suppresses the concern of the damage.

When the layers are not different in Young's modulus contrary to the fourth embodiment, deformation of the valve body by external force may concernedly cause damage such as separation or cracks at a boundary between the layers due to a difference in Young's modulus between the layers. With regard to such a concern, in the fourth embodiment, the respective layers of the corrosion-resistant layers 242 and the sacrificial corrosion layers 245 have different Young's moduli from one another. The Young's modulus of any of the layers gradually varies as the layer approaches the base material 241. It is therefore possible to reduce a difference in the Young's modulus between adjacent layers, which suppresses the concern of the damage.

Fifth Embodiment

Figure 9:
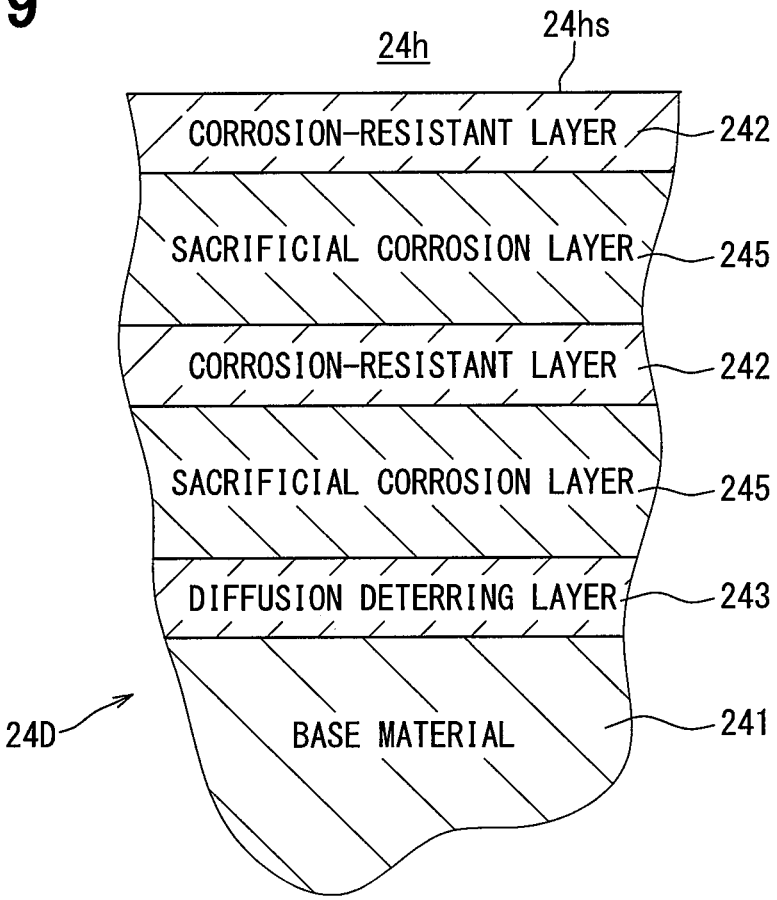
FIG. 9 is a sectional view of a valve body of a fifth embodiment.

In the valve body 24C of the fourth embodiment, the corrosion-resistant layer 242, the diffusion deterring layer 243, and the sacrificial corrosion layer 245 have the same thickness. On the other hand, in a valve body 24D of a fifth embodiment as shown in FIG. 9, thickness of the sacrificial corrosion layer 245 is set larger than thickness of each of the corrosion-resistant layer 242 and the diffusion deterring layer 243.

Hence, the fifth embodiment makes it possible to further reduce a possibility of arrival of the condensed water at the diffusion deterring layer 243 and the base material 241. In a possible modification of the fifth embodiment, thickness of the sacrificial corrosion layer 245 may be set smaller than that of each of the corrosion-resistant layer 242 and the diffusion deterring layer 243. Thicknesses of the plurality of the sacrificial corrosion layers 245 may be equal to or different from each other.

Although the plurality of embodiments of the disclosure have been described hereinbefore, not only a combination of configurations specified in description of the embodiments but also a partial combination of configurations in the embodiments can be used while being not specified as long as such a combination is not particularly disadvantageous. An unspecified combination of configurations described in the embodiments and modifications is also disclosed in the following description. Modifications of the embodiments are now described.

Although the material of the sacrificial corrosion layer 245 is more corrosive than the corrosion-resistant layer 242 in the above-described embodiments, the material may also be more corrosive than the base material 241. Alternatively, the material may be more corrosive than the corrosion-resistant layer 242 and less corrosive than the base material 241.

Although the diffusion deterring layer 243 is provided on a side opposite to the corrosion-resistant layer 242 with respect to the sacrificial corrosion layer 245 in the third embodiment, it may be provided on a side close to the corrosion-resistant layer 242 with respect to the sacrificial corrosion layer 245. In the third embodiment, although the diffusion deterring layer 243 is made of the material in which diffusion of the metal component of the base material 241 is less likely to occur than in the sacrificial corrosion layer 245, the diffusion deterring layer 243 may be made of a material in which such diffusion is less likely to occur than in the corrosion-resistant layer 242.

While the specific example of the material of the base material 241 includes the iron-based metal in the above-described embodiments, a further specific example includes case hardening steel, stainless steel, tool steel, and aluminum. The base material 241 may or may not necessarily be subjected to heat treatment such as hardening, carburizing, and nitriding. The base material 241 may be made of a metal oxide.

Although the thickness of the corrosion-resistant layer 242 is equal to the thickness of the sacrificial corrosion layer 245 in the first embodiment, the thickness may be smaller or larger than that thickness. When the valve body 24B has the diffusion deterring layer 243 as in the third embodiment, the thickness of the corrosion-resistant layer 242 may be equal to, smaller than, or larger than the thickness of the diffusion deterring layer 243.

In the above-described embodiments, diffusion is less likely to occur in the material of the diffusion deterring layer 243 than in the sacrificial corrosion layer 245 or the corrosion-resistant layer 242. In other words, an index of diffusibility of the metal component of the base material 241 is defined as diffusion coefficient, and the metal component is assumed to be more diffusible with an increase in the value of the diffusion coefficient. Thus, the diffusion deterring layer 243 has a smaller diffusion coefficient than the sacrificial corrosion layer 245 or the corrosion-resistant layer 242. Such a relationship of the diffusion coefficient may be true in an atmosphere of 500° C. or lower. In addition, the diffusion coefficient relationship may be true in the case where the base material 241 is made of an iron-based metal.

In the above-described embodiments, the corrosion-resistant layer 242, the sacrificial corrosion layer 245, and the diffusion deterring layer 243 are each formed by an ALD process. On the other hand, the layers may each be formed by a chemical vapor deposition process other than ALD, or by a process other than the chemical vapor deposition process, for example, plating.

In the above-described embodiments, the sacrificial corrosion layer 245 and the corrosion-resistant layer 242 are provided on the entire surface of the base material 241, i.e., on the entire inner wall surface 24in and the entire outer wall surface 24out (see FIG. 2). On the other hand, such layers may not necessarily be provided in a portion, which is covered with the retaining nut 25, of the valve body 24. The sacrificial corrosion layer 245 and the corrosion-resistant layer 242 are provided in at least a portion of the valve body 24, in which the injection holes 24*h* are formed.

In the above-described embodiments, the corrosion-resistant layer 242 and the sacrificial corrosion layer 245 are provided for the fuel injection valve 10 as a subject, which is mounted in an internal combustion engine having a function of refluxing a part of exhaust gas into intake air. On the other hand, the corrosion-resistant layer 242 and the sacrificial corrosion layer 245 may be provided for a fuel injection valve as a subject, which is mounted in an internal combustion engine that does not have such a refluxing function.

In the fourth embodiment, the respective layers of the corrosion-resistant layers 242 and the sacrificial corrosion layers 245 are different in each of the linear expansion coefficients and the Young's modulus from one another. On the other hand, the layers may be equal in one of the linear expansion coefficient and the Young's modulus while being different in the other of them, or may be equal in both the linear expansion coefficient and the Young's modulus.

Although the valve body 24A of the second embodiment has the plurality of intermediate layers 244, the valve body may have one intermediate layer 244. Although the linear expansion coefficient or the Young's modulus of any of the intermediate layers 244 gradually varies in the second embodiment, the intermediate layers 244 may have the same linear expansion coefficient or Young's modulus.

In the above-described embodiments, the diffusion deterring layer 243 is provided while being in contact with the base material 241. On the other hand, another layer may be provided between the diffusion deterring layer 243 and the base material 241 so that the diffusion deterring layer 243 is not in contact with the base material 241.

Characteristics of the fuel injection valve 10 of the above embodiments can be described as follows.

A fuel injection valve 10 in an aspect of the present disclosure includes a body 24, 24A, 24B, 24C, 24D that includes an injection hole 24*h* through which fuel is injected, and a valve element 30 that opens or closes the injection hole 24*h*. The body 24, 24A, 24B, 24C, 24D includes a metallic base material 241 configured to form the injection hole 24*h*, a corrosion-resistant layer 242 covering a surface of at least a part of the base material 241 that forms the injection hole 24*h* and being made of a less corrosive material than the base material 241, and a sacrificial corrosion layer 245 located between the base material 241 and the corrosion-resistant layer 242 and made of a more corrosive material than the corrosion-resistant layer 242.

Strictly, a defect exists in the corrosion-resistant layer 242, and may penetrate the corrosion-resistant layer 242 in a thickness direction. Hence, when the sacrificial corrosion layer 245 is not provided contrary to the above-described aspect so that the corrosion-resistant layer 242 is directly provided on the surface of the base material 241, the condensed water adhering to the surface of the corrosion-resistant layer 242 reaches the base material 241 through the defect, leading to a concern of corrosion of the base material 241. Although the defect is extremely small and thus only a slight amount of the condensed water reaches the base material 241, such a slight amount of the condensed water is also not negligible in recent years in which a demand for a measure against corrosion is increased with an increase in the EGR amount as described above.

According to such observation, the fuel injection valve 10 in the above-described aspect has the sacrificial corrosion layer 245 that is located between the base material 241 and the corrosion-resistant layer 242 and made of the material more corrosive than the corrosion-resistant layer 242. Hence, even when condensed water adhering to the surface of the corrosion-resistant layer 242 penetrate the corrosion-resistant layer 242, such condensed water is subjected to an oxidation reaction in the sacrificial corrosion layer 245 and undergoes a chemical change, which suppresses arrival of the condensed water at the base material 241. It is therefore possible to suppress oxidation (corrosion) of the base material 241 by the condensed water.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

What is claimed is:

1. A fuel injection valve comprising:

a body that includes an injection hole through which fuel is injected; and a valve element that opens or closes the injection hole, wherein the body includes:

a metallic base material configured to form the injection hole;

a first sacrificial corrosion layer directly or indirectly formed on the metallic base material to cover a surface of at least a part of the metallic base material that forms the injection hole;

a first corrosion-resistant layer formed on the first sacrificial corrosion layer and being made of a less corrosive material than the base material;

a second sacrificial corrosion layer formed on the first corrosion-resistant layer;

a second corrosion-resistant layer formed on the second sacrificial corrosion layer and being made of a less corrosive material than the base material;

wherein each of the first and the second sacrificial corrosion layers is made of a more corrosive material than each of the first and the second corrosion-resistant layers, wherein a linear expansion coefficient or Young's modulus of the first sacrificial corrosion layer is different from that of the second sacrificial corrosion layer, and wherein a linear expansion coefficient or Young's modulus of the first corrosion-resistant layer is different from that of the second corrosion-resistant layer.

2. The fuel injection valve according to claim 1, wherein the material of at least on of the first or second the sacrificial corrosion layers liquates out at a hydrogen-ion exponent of 4 or less.

3. A fuel injection valve comprising:

a body that includes an injection hole through which fuel is injected; and a valve element that opens or closes the injection hole, wherein the body includes:

a metallic base material configured to form the injection hole;

a diffusion deterring layer formed on the metallic base material to cover a surface of at least a part of the metallic base material that forms the injection hole a first sacrificial corrosion layer formed on the diffusion deterring layer;

a first corrosion-resistant layer formed on the first sacrificial corrosion layer and being made of a less corrosive material than the base material;

a second sacrificial corrosion layer formed on the first corrosion-resistant layer;

a second corrosion-resistant layer formed on the second sacrificial corrosion layer and being made of a less corrosive material than the base material;

wherein each of the first and the second sacrificial corrosion layers is made of a more corrosive material than each of the first and the second corrosion-resistant layers, wherein the diffusion deterring layer is made of a material that less easily allows a metal component of the metallic base material to diffuse than the material of the first and/or the second corrosion-resistant layer, wherein a linear expansion coefficient or Young's modulus of the first sacrificial corrosion layer is different from that of the second sacrificial corrosion layer, and wherein a linear expansion coefficient or Young's modulus of the first corrosion-resistant layer is different from that of the second corrosion-resistant layer.

* * * * *